US010767441B2

(12) United States Patent
Sharp, III

(10) Patent No.: US 10,767,441 B2
(45) Date of Patent: Sep. 8, 2020

(54) STORM PLUG PACKER SYSTEM AND METHOD

(71) Applicant: Harvey Sharp, III, Gray, LA (US)

(72) Inventor: Harvey Sharp, III, Gray, LA (US)

( * ) Notice: Subject to any disclaimer, the term of this patent is extended or adjusted under 35 U.S.C. 154(b) by 0 days.

(21) Appl. No.: 16/119,453

(22) Filed: Aug. 31, 2018

(65) Prior Publication Data

US 2020/0072015 A1 Mar. 5, 2020

(51) Int. Cl.
*E21B 33/128* (2006.01)

(52) U.S. Cl.
CPC ..... *E21B 33/128* (2013.01)

(58) Field of Classification Search
CPC ..... E21B 19/06; E21B 33/128
See application file for complete search history.

(56) References Cited

U.S. PATENT DOCUMENTS 2,179,594 A 11/1939 Johnson
4,643,472 A 2/1987 Schukei et al.
5,967,477 A 10/1999 Walmsley
7,445,050 B2 11/2008 Kuttel et al.
7,552,764 B2 6/2009 Weems et al.
7,744,140 B2 6/2010 Rowley
9,273,523 B2 3/2016 McIntosh et al.
9,797,207 B2 10/2017 McIntosh et al.
10,164,418 B2 * 12/2018 Thomson ..... H02G 1/10

* cited by examiner

*Primary Examiner* — Kristyn A Hall
(74) *Attorney, Agent, or Firm* — Keaty Law Firm LLC

(57) ABSTRACT

A storm plug packer apparatus and method for securely and reversibly packing a cased well, allowing removal of the drill string above the plug in circumstances such as evacuation ahead of a storm, and resumption of drilling operations afterward, and allows operations by other tools that need to be temporarily fixed to the inside of the casing. Transfer balls are arrayed radially about the circumference of an outer sleeve, recessed in mounting holes behind ball-retainer rings and deformable membranes, and accommodated by troughs in an inner sleeve in an unset state. In a set state, the inner sleeve moves downward in relation to the outer sleeve, and the crenated, ramped axial profile of the inner sleeve pushes the transfer balls outwards, against the deformable membranes and in turn against the inside of the well casing, fixing the storm plug packer and all tools below it in place.

20 Claims, 5 Drawing Sheets

STORM PLUG PACKER SYSTEM AND METHOD

BACKGROUND

This invention provides a storm plug packer apparatus and method for securely and reversibly packing a cased well, allowing fast and safe removal of the drill string above the plug in circumstances such as in an evacuation ahead of a storm, and fast and safe resumption of drilling operations afterward, and allows operations by other tools that need to be temporarily fixed to the inside of the casing.

In drilling operations, it is sometimes necessary to pull coiled tubing out of the hole for a day or several days in order to either repair or replace equipment or to secure equipment and personnel against hazards such as an approaching storm. It is often desirable to avoid pulling the entire workstring or parts of the workstring out of the hole, but if the workstring is left in the hole, then it must be secured in place against the casing, and it must be possible to re-attach to the workstring upon resuming drilling operations. Because the tubing will, or might, be disconnected from the workstring, no hydraulic fluid can be supplied in order to keep hydraulic-dependent packers deployed or to adjust the amount of gripping force that the packers exert on the casing.

In addition, the use of certain other tools creates a need to temporarily fix the workstring in position against the casing, and then to release the workstring to move within the hole, preferably without having to pull out of the hole and add a trip in the process.

The prior art does not provide for a storm plug packer that operates independently of the hydraulic fluid and that can be set and unset, and can adjust the pressure exerted on the casing, according to the balance of upward and downward pull acting on the storm plug packer.

For example, U.S. Pat. No. 9,273,523 for a "Tubular Running Device and Method," issued on Mar. 1, 2016 to assignee 2M-TEK, Inc., provides for a method and apparatus for running tubulars into a well bore for use with a top drive or power swivel. The system comprises a make-up assembly with inner and outer members, one of which has an array of ramped or inclined surfaces, while the other is an inner or outer cage with rolling supports with or without a central spindle and openings, which may also be referred to as a tubular engagement apparatus. Relative movement of the members urges the rolling supports to protrude radially through the openings to engage a tubular, internally or externally. Also provided is an elevator assembly with elevator links and transfer elevators to position the tubular for engagement by the make-up assembly.

U.S. Pat. No. 4,643,472 for a "Rapid Installation Tube Gripper," issued on Feb. 17, 1987 to assignee Combustion Engineering, Inc., provides for a gripper device developed for attachment to the inside of a tube, and includes a shaft member with an upper tapered portion surrounded by a generally cylindrical sleeve member with at least two holes opposite the tapered portion of the shaft. The sleeve outer diameter is slightly less than the inner diameter of the tube targeted for attachment. A spring is connected between the shaft member and the sleeve member, for biasing the tapered shaft downwardly relative to the sleeve. A round bearing or hard ball is located in each hole, such that downward motion of the shaft relative to the sleeve urges the balls outwardly to protrude from the sleeve surface against the tube wall. The device is installed by pushing on the stem at the lower end of the shaft member to insert the device into the tube. A flange is formed at the lower end of the sleeve to limit the sleeve insertion into the tube. In that manner, the tapered portion may be pushed longitudinally upward relative to the holes, whereby the balls are retracted into the sleeve and the device may be installed into or removed from the tube.

U.S. Pat. No. 7,552,764 for a "Tubular Handling Device," issued on Jun. 30, 2009 to assignee Nabors Global Holdings, Ltd., provides for a tubular handling apparatus with a slotted member having a plurality of elongated slots, each extending in a direction; a recessed member slidably coupled to the slotted member and featuring a plurality of recesses each tapered in the direction from a shallow end to a deep end; and a plurality of rolling members, each retained between one of the recesses and one of the slots. Each rolling member partially extends through the adjacent slot when located in the shallow end of the recess, and each rolling member retracts within an outer perimeter of the slotted member when located in a deep end of the recess. The apparatus may further comprise a plurality of biasing elements, each biasing a corresponding one of the rolling members towards the shallow end of the corresponding recess.

U.S. Pat. No. 7,445,050 for a "Tubular Running Tool," issued on Nov. 4, 2008 to assignee Canrig Drilling Technology, Ltd., provides for an apparatus for handling a tubular segment, coupling the tubular segment with a tubular string for handling the tubular string in a well bore. The apparatus has a tubular engagement assembly that connects to a drive shaft of a top drive. The tubular engagement assembly has a self-engaging ball and taper assembly that releasably engages the tubular segment. When the tubular engagement assembly connects to the drive shaft and the ball and taper assembly engages the tubular segment, any rotation in the drive shaft results in rotation of the tubular segment. That rotation in turn allows the tubular segment to engage the tubular string.

U.S. Pat. No. 7,744,140 for a "Gripping Device," issued on Jun. 29, 2010 to assignee BSW Limited, provides for a mooring connector or pipeline recovery tool comprising a mandrel, around which is concentrically disposed a ball cage with balls protruding therefrom so that relative longitudinal movement of the mandrel and ball cage causes the balls to ascend ramped surfaces of the mandrel, thus to protrude outwardly through the ball cage. The conventional arrangement of balls in regular rows and columns is replaced by helical rows or random arrays of the balls, thus to avoid excessive grooving and deformation of the wall of a receptor into which the connector is inserted. Specifically, the gripping device comprises a first elongate member; a plurality of ramped surfaces spaced apart thereon the elongate member; and a second elongate member superimposed with respect to the ramped surfaces of the first elongate member. The second elongate member is tubular and of circular cross-section, having the first elongate member concentrically disposed within it. The device also includes a plurality of rolling members captively retained within apertures of the second elongate member, so as to reside respectively on the ramped surfaces of the first elongate member; means permitting relative movement of the first and second elongate members in a longitudinal direction of the tubular second elongate member to cause the rolling members to ascend the ramped surfaces so as to protrude partially through their respective apertures. The device is particularly characterized in that the rolling members and their respective ramped surfaces and apertures are disposed in helical arrays about the device, such that from one end of the second elongate member to an opposite end of the second elongate member, no axially directed continuous spaces remain between the rolling members.

U.S. Pat. No. 5,967,477 for "Clamps," issued on Oct. 19, 1999 to assignee Robert Emmett, provides for a clamp that comprises a tubular support with a number of axially spaced sets of angularly spaced apertures for receiving spheres engageable with the exterior of a pipe and with tapered surfaces on a clamp body. In use, a spring urges the support down in relation to the body to cause the spheres to grip the pipe. Rams can raise the support to release the clamp, whereupon the spheres can enter recesses in the body. The apertures may be axially elongated to accommodate a degree of pipe ovality and have diverging walls for the same purpose. A form of the clamp for gripping a pipe interior is also disclosed. The clamp may have one or more seals for sealing against the pipe, and two oppositely acting clamps may form a connector for two pipes. Specifically, the internal form of the clamp is self-engaging and self-disengaging. On being lowered, the ball cage enters the pipe and allows the body to move down and for the balls to retract radially inwards. The load is then slowly applied by raising the body and the pipe gripped by the balls, which are moved outwards. On disengagement, the load is removed and the body moves down as before. The clamp is then quickly removed and disengaged. A hydraulic damper pivoted to the cage and body is attached to the body and cage by pins, one of which is engaged in an axial slot and allows a certain amount of free movement of the body within the ball cage. The damper acts as a time delay. Thus, when it is desired to release the pipe, the body is lowered, compressing the damper, and the balls move inwards, releasing the grip. Before the damper can return to its extended datum position, the whole clamp is lifted out of the end of the pipe or casing.

U.S. Pat. No. 2,179,594 for a "Well Tool," issued on Nov. 14, 1939 to inventor Albert E. Johnson, provides for a device for setting and pulling sand points in an oil well, or for fishing lost pipe from a well. The well tool comprises a body, having a shank; a cam shoulder about the lower end of the shank; a threaded portion at the upper end of the shank; a sleeve, fitting loosely about the shank and formed with openings through its wall; gripping members movable radially of the sleeve through the openings from a retracted position to an extended position, where the gripping members are movable to the extended position by engagement with the cam shoulder when the sleeve is in a lowered position, where the shank has a radial pocket and the sleeve has an opening adapted to aligned with the pocket for insertion of the gripping members; a removable plug normally filling the pocket; and a collar carried by the upper end of the sleeve and internally threaded for engagement with the threaded portion to releasably hold the sleeve in a raised position.

Lastly, U.S. Pat. No. 9,797,207 for an "Actuator Assembly for Tubular Running Device," issued on Oct. 24, 2017 to assignee 2M-TEK, Inc., provides for an actuator assembly developed for operating a tubular running device, and includes a housing assembly coupled to the outer cage. The housing assembly is movable relative to the inner mandrel. An upper fluid chamber is disposed between the housing assembly and the inner mandrel, and a lower fluid chamber is disposed between the housing assembly and the inner mandrel. Fluid pumped through an upper pressure port into the upper chamber moves the housing assembly in a first direction, thereby causing the gripping apparatus to engage the tubular, and fluid pumped through a lower pressure port into the lower fluid chamber moves the housing assembly in a second direction, thereby causing the gripping apparatus to disengage the tubular.

What is needed is a storm plug packer that operates independently of the hydraulic fluid and that can be set and unset, and can adjust the pressure exerted on the casing, according to the balance of upward and downward pull acting on the storm plug packer.

SUMMARY OF THE INVENTION

This invention provides a storm plug packer apparatus and method for securely and reversibly packing a cased well, allowing fast and safe removal of the drill string above the plug in circumstances such as in an evacuation ahead of a storm, and fast and safe resumption of drilling operations afterward, and allows operations by other tools that need to be temporarily fixed to the inside of the casing.

A number of transfer balls are arrayed radially about the circumference of an outer sleeve, recessed in mounting holes behind ball-retainer rings and deformable membranes, and accommodated by troughs in an inner sleeve, while an upward pull is exerted on the storm plug packer by the up-hole portion of the drill string. When upward pull is neutralized or reversed, the inner sleeve moves downward in relation to the outer sleeve, and the crenated, ramped axial profile of the inner sleeve pushes the transfer balls outwards, against the deformable membranes and in turn against the inside of the well casing, fixing the storm plug packer and all tools below it in place. Upon reapplication of an upward pull, the inner sleeve moves upward in relation to the outer sleeve, allowing the transfer balls to recess back within the circumference of the outer sleeve, allowing free movement of the storm plug packer and the drill string.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
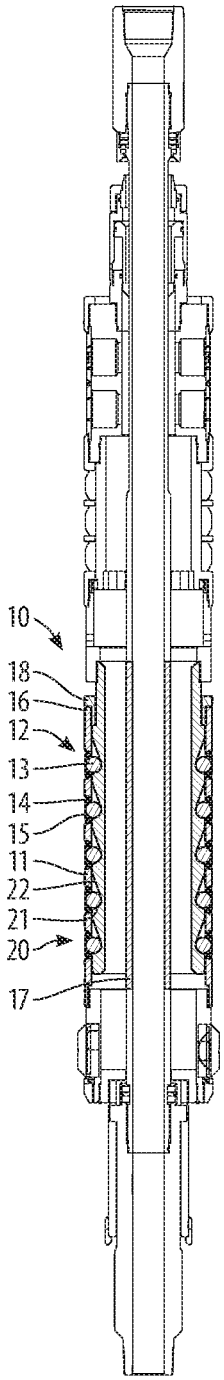
FIG. 1 is a section view of the storm plug of the invention in use on a drill string in an unset state.
Figure 2:
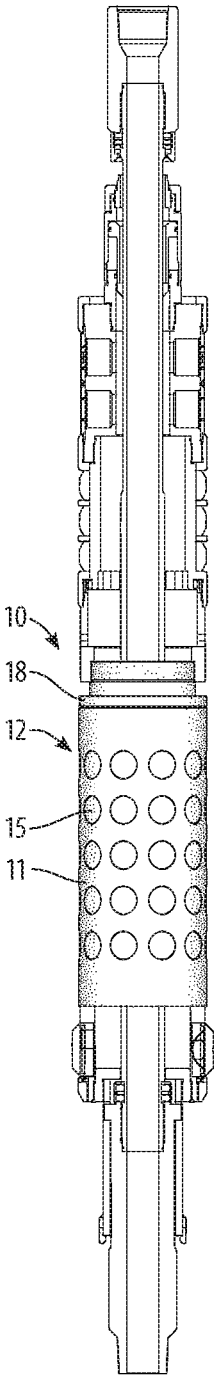
FIG. 2 is a side view of the storm plug of the invention in use on a drill string in an unset state.
Figure 3:
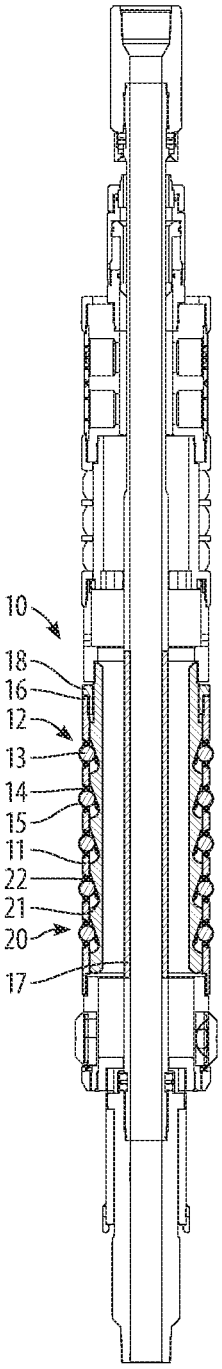
FIG. 3 is a section view of the storm plug of the invention in use on a drill string in a set state.
Figure 4:
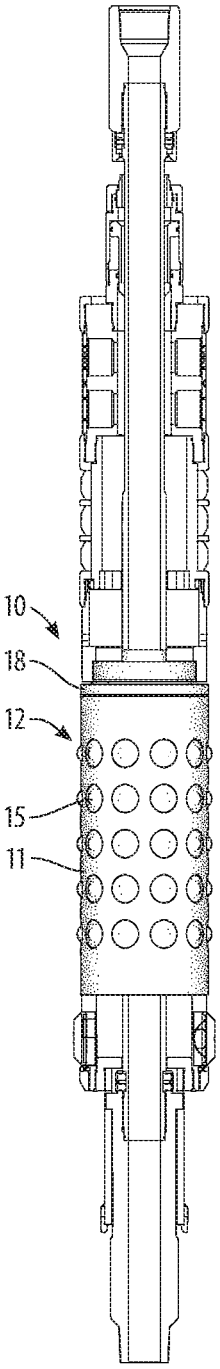
FIG. 4 is a side view of the storm plug of the invention in use on a drill string in a set state.

Referring to FIG. 1 and FIG. 2, the storm plug packer 10 of the invention is shown mounted on a drill string. When the up-hole portions of the drill string are supporting and countering the weight of the down-hole portions, such that substantially equal upward and downward forces are acting on the storm plug packer, the effective circumference of the storm plug packer does not extend past the normal circumference of the packer and the other tools on the drill string. Referring additionally to FIG. 3 and FIG. 4, when the upward pull from the drill string above is neutralized, such as by conventional packers mounted above, or reversed into a downward push, the effective circumference of the storm plug packer is increased by a large number of protrusions capable of making enough frictional contact with the well casing to become fixed in place. The up-hole portions of the drill string and tubing can then be safely uncoupled and withdrawn from the hole. The storm plug packer supports the weight of the down-hole portions of the drill string and safely plugs the hole. This allows the storage or removal of the up-string equipment and the relocation of personnel, such as the measures taken ahead of an approaching storm. Afterwards, drilling operations can be quickly and safely re-started by re-attaching the drill string to the storm plug packer and pulling upward until the upward force substantially equals the downward force acting on the storm plug packer. The storm plug packer 10 is also useful in conjunction with any other tool which needs to grab a connection to the inside of the casing to perform an operation.

Figure 5:
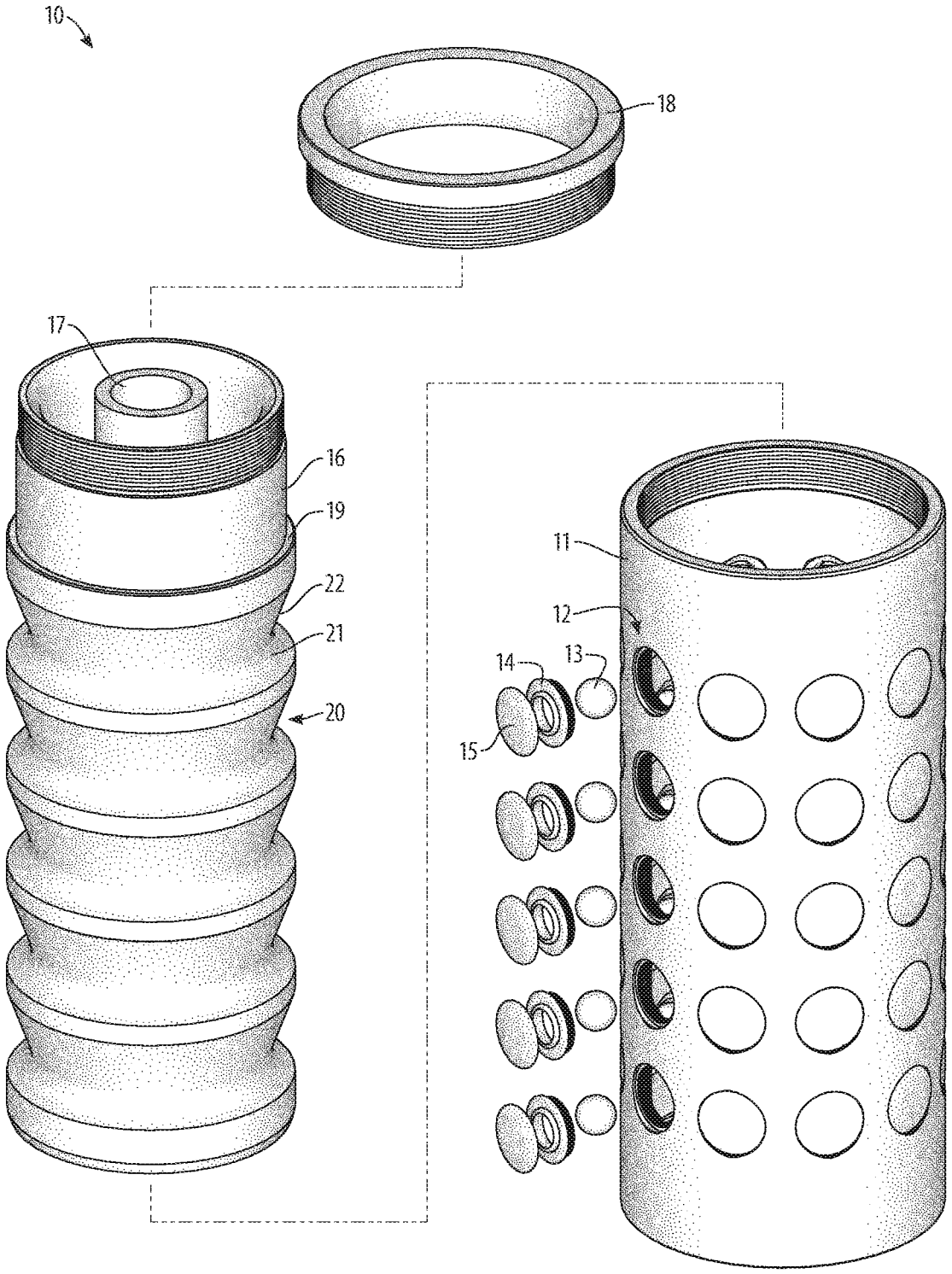
FIG. 5 is an exploded view of the storm plug of the invention.

Referring additionally to FIG. 5, the storm plug packer 10 provides an outer sleeve 11 and an inner sleeve 16. The inner sleeve 16 fits within the outer sleeve 11 and the two sleeves can slide axially in reference to each other. The inner sleeve provides a through-pipe 17 to provide a through connection for movement of drilling fluids. The circumference of the up-hole portion of the inner sleeve 16 is set inward, forming a step or shoulder 19, and the extreme up-hole portion of the inner sleeve 16 provides a threaded connection to the up-hole portions of the drill string. The upward movement of the inner sleeve 16 within the outer sleeve 11 is stopped by a guide-retainer ring 18 which is coupled to the up-hole portion of the outer sleeve 11 such that the down-hole portion of the guide-retainer ring 18 forms a smaller-circumference step on the inside surface of the outer sleeve 11 near its up-hole portion. The inner surface of the guide-retainer ring 18 allows for sliding of the inward-set up-hole portion of the inner sleeve 16, and such sliding is stopped by the contact of the outward-stepped outer surface of the inner sleeve 16 with the lower surface of the guide-retainer ring 18, which functions as an inward step or shoulder on the inner surface of the outer sleeve 11. The extreme down-hole portion of the outer sleeve 11 provides a threaded connection to the down-hole portions of the drill string. The inner sleeve 16 is therefore connected to the up-hole components of the drill string, and the outer sleeve 11 is connected to the down-hole components. The inner sleeve 16 and the outer sleeve 11 are allowed to slide in relation to each other over a limited distance, and the inner sleeve 16 is prevented from slipping in an up-hole directions out of the outer sleeve 11 by the guide-retainer ring 18.

Figure 6:
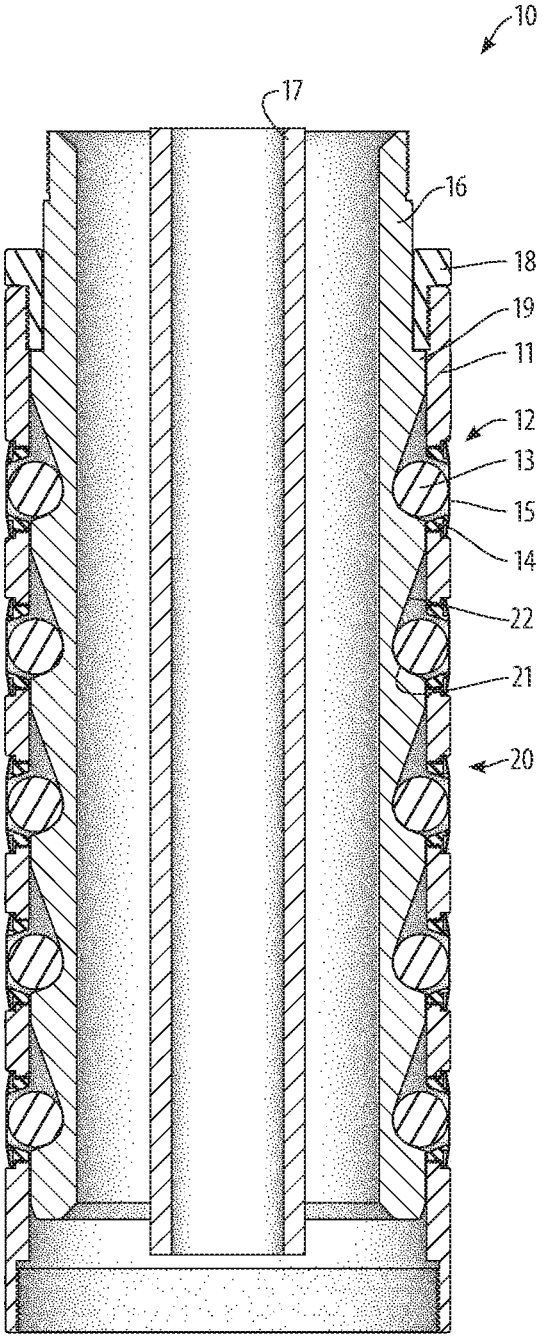
FIG. 6 is a cross-section view of the storm plug of the invention in an unset state.
Figure 7:
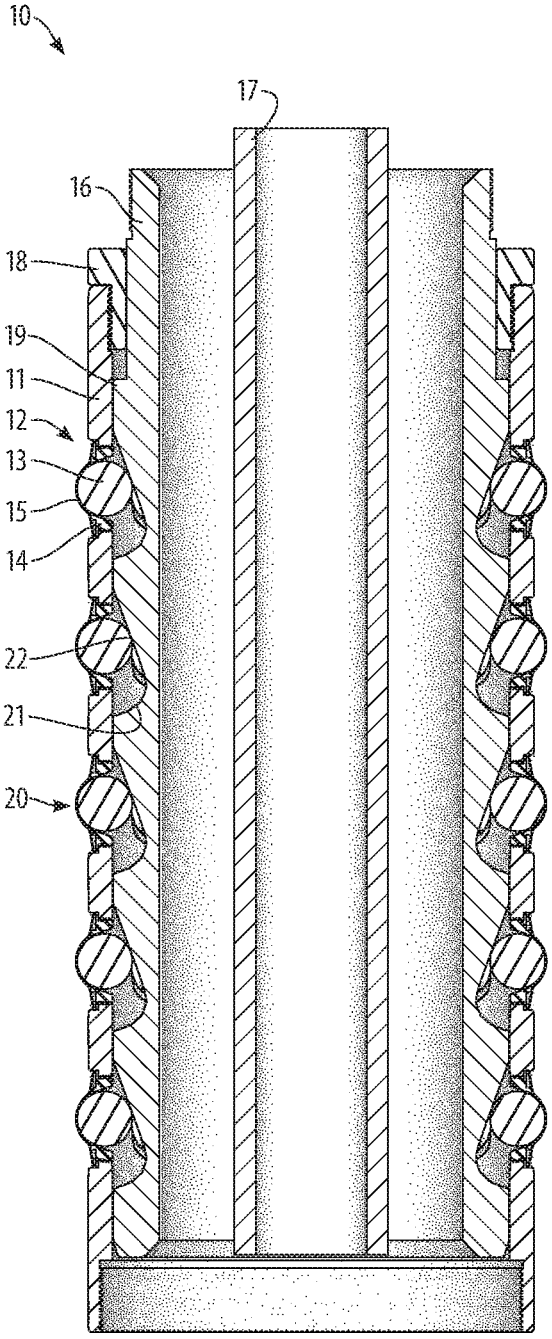
FIG. 7 is a cross-section view of the storm plug of the invention in a set state.

Referring additionally to FIG. 6 and FIG. 7, the inner sleeve 16 has an axial profile which is crenated or scalloped into several bands 20, where each band starts on the down-hole portion with a circumference equal to the overall outer circumference of the inner sleeve 16, which corresponds to the inner circumference of the outer sleeve 11. Progressing in an up-hole direction, the profile of each band then makes a sharp reduction in circumference 21 down to a minimum, and then makes a gradual sloped or tapered increase of circumference 22 back to the starting point of the overall outer circumference. In three dimensions, each band 20 forms a trough 21 having a down-hole steep return to full circumference and an up-hole ramped 22, gradual return to full circumference.

Figure 8:
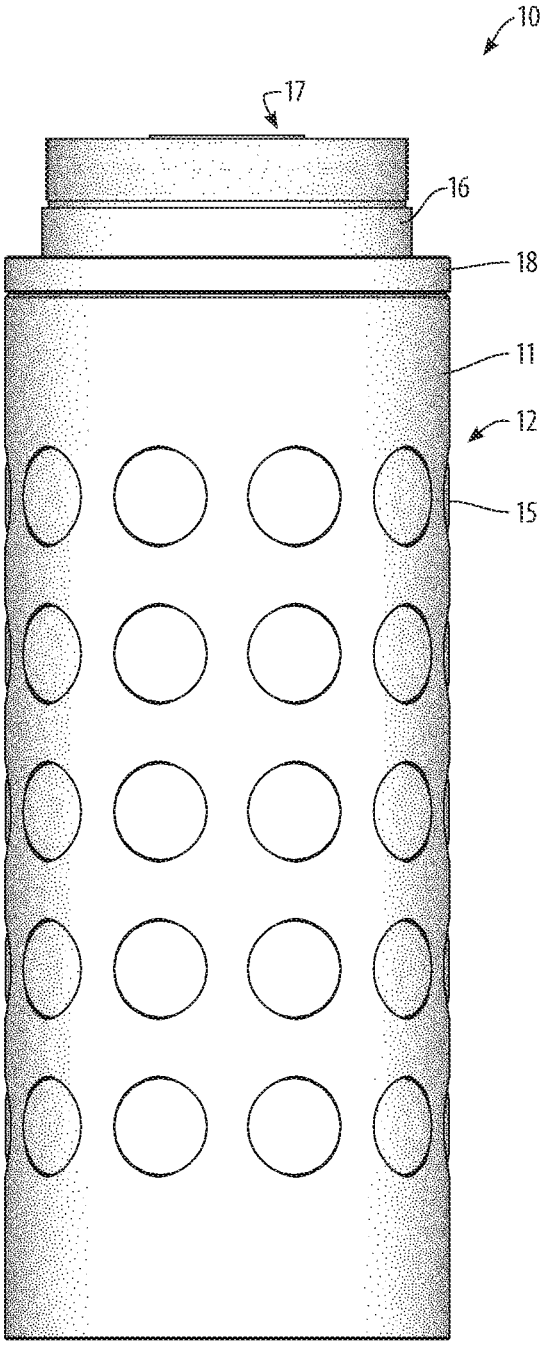
FIG. 8 is an elevation view of the storm plug of the invention in an unset state.
Figure 9:
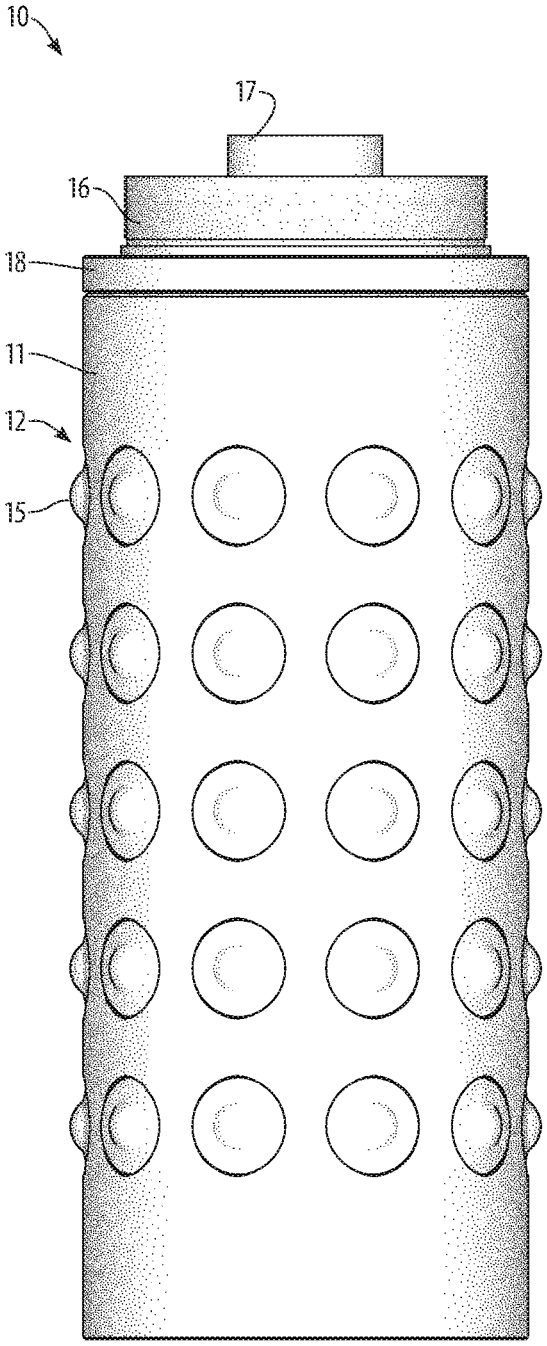
FIG. 9 is an elevation view of the storm plug of the invention in a set state.

Referring additionally to FIG. 8 and FIG. 9, the outer sleeve 11 provides mounting holes 12 arrayed radially on its outer surface through the inner surface. Transfer balls 13 are placed within the mounting holes 12 such that they rest against the outer surface of the inner sleeve 16. Ball-retainer rings 14 secure the transfer balls 13 within the mounting holes 12 while allowing a portion of the transfer balls 13 to protrude through the rings and therefore protrude past the outer circumference of the outer sleeve 11. Deformable membranes 15 are placed over the ball-retainer rings 14 and transfer balls 13. The deformable membrane 15 can be made of material such as rubber or silicone.

The trough 21 of each band 20 around the inner sleeve 16 is sized to allow the corresponding transfer balls 13 to sit completely within the normal circumference of the outer sleeve 11, within the corresponding mounting holes 12, secured by the ball-retainer rings 14, and not applying any significant force to the deformable membranes 15. The up-hole portion of the inner sleeve 16 is attached to the up-hole portion of the drill string and is therefore pulled upward in relation to the outer sleeve 11, so that the stepped portion 19 of the inner sleeve is caught and stopped by the guide-retainer ring 18 which is mounted on the outer sleeve 11. In this condition, with the transfer balls 13 retracted into the deepest portions of the troughs 21, the overall storm plug packer 10 moves easily on the drill string within the casing of the well.

Figure 10:
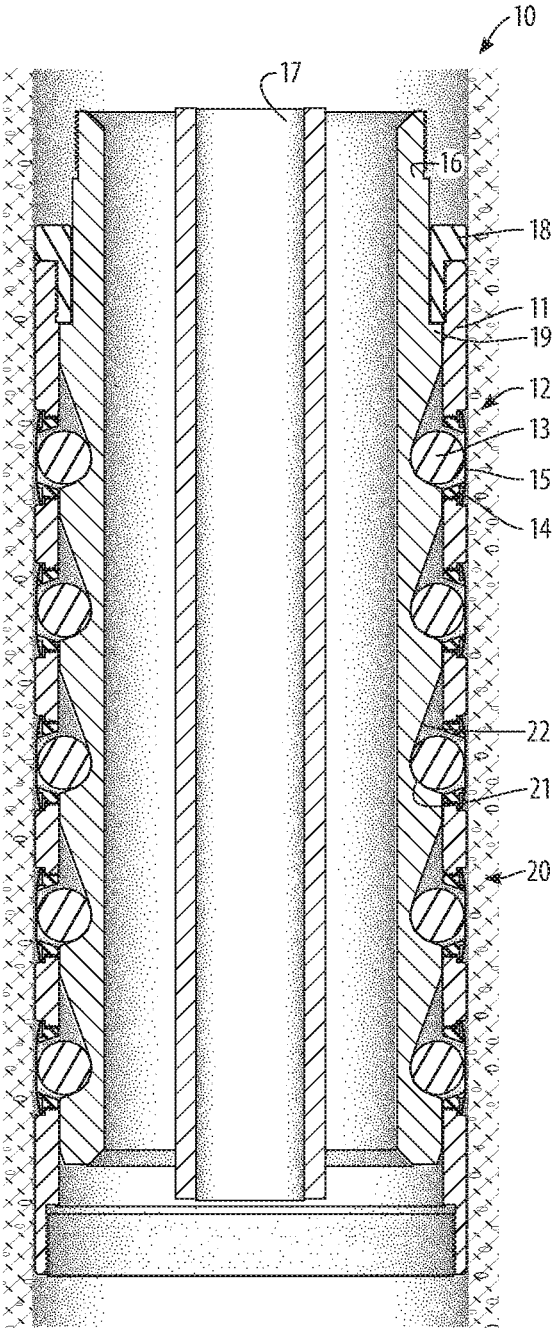
FIG. 10 is a cross-section schematic view of the storm plug of the invention in use in an unset state.
Figure 11:
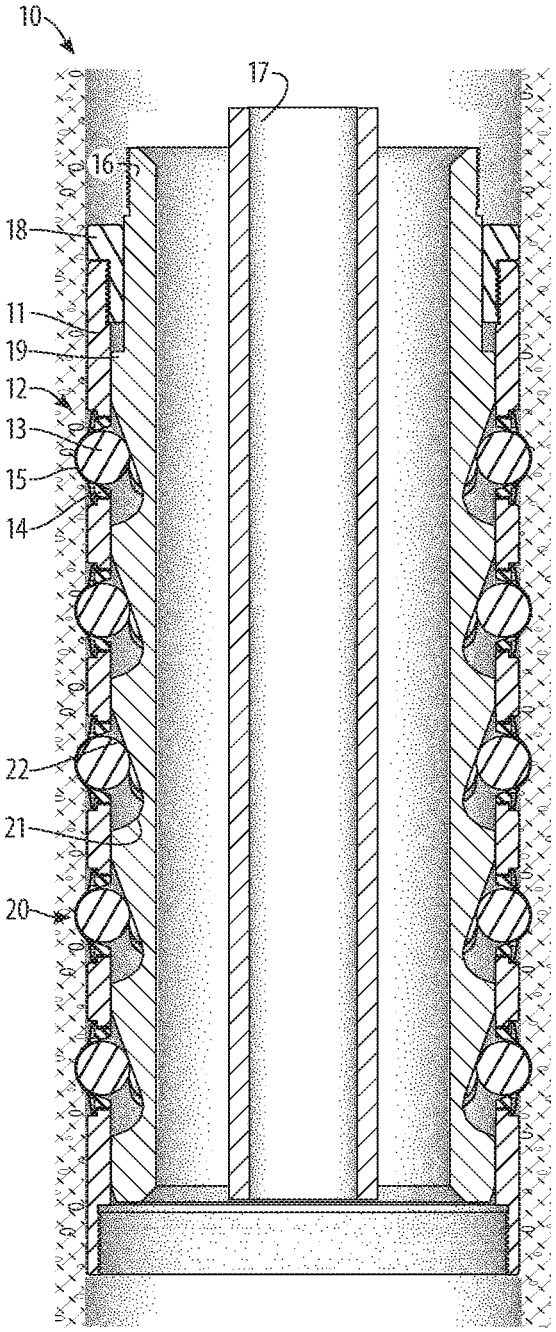
FIG. 11 is a cross-section schematic view of the storm plug of the invention in use in a set state.

Referring to FIG. 10 and FIG. 11, in use, when the upward pull on the inner sleeve 16 from the drill string above becomes neutralized or becomes a downward pushing force, by the action of conventional packers above or otherwise, the inner sleeve 16 will slide downward with respect to the outer sleeve 11. This downward movement will place the ramped 22, gradually-increasing-in-circumference portions of the inner sleeve 16 into contact with the corresponding transfer balls 13, which are not allowed to move downward with the inner sleeve 16. Instead, the transfer balls 13 are pushed out radially by the inner sleeve 16. The transfer balls 13 are prevented from being pushed completely out of the outer sleeve by the ball-retainer rings 14, which have circular openings of a circumference somewhat smaller than the circumference of the transfer balls 13. But the transfer balls 13 are allowed to be pushed out sufficiently to deform the deformable membranes 15, which push out beyond the normal circumference of the outer sleeve and make tight frictional contact with the casing of the well. At this point the storm plug packer 10 has been deployed and will hold the down-hole portions of the drill string in place. With the storm plug packer 10 deployed, the tubing and drill string above can be removed ahead of an approaching storm, or operations by other tools which need a firm fix to the inside of the casing can be performed.

After deployment, when the drill string above resumes a significant upward pull upon the inner sleeve 16, the inner sleeve will slide upward in relation to the outer sleeve 11, placing the troughs 21 of the inner sleeve 16 behind the transfer balls 13, allowing the transfer balls to retract within the normal circumference of the outer sleeve 11, which releases the frictional contact with the casing and allows normal up-and-down-hole movement of the entire drill string.

Many other changes and modifications can be made in the system and method of the present invention without departing from the spirit thereof. I therefore pray that my rights to the present invention be limited only by the scope of the appended claims.

I claim:

1. A storm plug packer for use on a drill string in a casing, and having an up-hole and down-hole orientation, the storm plug packer comprising:

(i) an outer sleeve having a normal circumference providing a close but unrestricted fit within the casing, and having a mounting point at a down-hole end for attachment to down-hole components of the drill string;

(ii) a plurality of mounting holes arrayed radially through the circumference of said outer sleeve;

(iii) a plurality of transfer balls accommodated one each in said mounting holes such that said transfer ball does not extend radially beyond the normal circumference of said outer sleeve;

(iv) a plurality of ball-retainer rings each adapted to allow said transfer ball to partially extend beyond the normal circumference of said outer sleeve, and to prevent said transfer ball from completely exiting said mounting hole;

(v) a plurality of deformable membranes each adapted to cover said transfer ball;

(vi) an inner sleeve having a crenated axial profile, having radial bands each comprising at a down-hole portion a trough corresponding to the size of said transfer balls and at an up-hole portion a ramped gradual increase in circumference up to a maximum circumference allowing sliding within said outer sleeve, having on an up-hole portion a stepped reduction in circumference forming an outer shoulder, and having a mounting point on an up-hole end for attachment to up-hole components of the drill string; and (vii) a guide-retainer ring having an outer surface adapted to mount upon said outer sleeve, having an inner surface adapted to allow sliding movement of said inner sleeve, and having a down-hole surface adapted to serve as an inner shoulder upon said outer sleeve;

where, in use, in an un-set state, when the drill string places an upward force on said inner sleeve, said inner sleeve slides upward within said outer sleeve to the limit of contact between the outer shoulder of said inner sleeve and the inner shoulder of said guide-retainer ring and said outer sleeve, where said transfer balls are accommodated within the troughs of said inner sleeve, and where said transfer balls do not extend beyond the normal circumference of said outer sleeve;

where, in use, in a set state, when the drill string does not place an upward force on said inner sleeve, said inner sleeve slides downward within said outer sleeve, placing the gradual increased circumference portions of said inner sleeve in contact with said transfer balls, forcing said transfer balls radially outward, to the limit of said ball-retainer rings, against said deformable membranes, and past the normal circumference of said outer sleeve into frictional contact with the casing, thereby setting said storm plug packer and attached down-hole components in fixed positions within the casing; and where, in use, upon re-application of an upward force to said inner sleeve, returning to an un-set state, said inner sleeve slides back into the position allowing said transfer balls to retract into the troughs of said inner sleeve, thereby unsetting said storm plug packer, allowing movement of the drill string.

2. The storm plug packer of claim 1, where said deformable membranes are made of rubber.

3. The storm plug packer of claim 1, where said deformable membranes are made of silicone material.

4. The storm plug packer of claim 1, where said transfer balls are made of steel.

5. The storm plug packer of claim 1, where said transfer balls are made of a non-sparking material.

6. The storm plug packer of claim 1, where said transfer balls are made of brass.

7. The storm plug packer of claim 1, where said guide-retainer ring is made of a non-sparking material.

8. The storm plug packer of claim 1, further comprising manufacture of said transfer balls from non-sparking materials.

9. The storm plug packer of claim 1, further comprising fifty of said transfer balls.

10. The storm plug packer of claim 1, where each said radial band further comprises ten said mounting holes radially arrayed.

11. A storm plug packer method for use on a drill string in a casing, and having an up-hole and down-hole orientation, the storm plug packer method comprising:

(i) providing a storm plug packer apparatus, comprising:

(a) an outer sleeve having a normal circumference providing a close but unrestricted fit within the casing, and having a mounting point at a down-hole end for attachment to down-hole components of the drill string;

(b) a plurality of mounting holes arrayed radially through the circumference of said outer sleeve;

(c) a plurality of transfer balls accommodated one each in said mounting holes such that said transfer ball does not extend radially beyond the normal circumference of said outer sleeve;

(d) a plurality of ball-retainer rings each adapted to allow said transfer ball to partially extend beyond the normal circumference of said outer sleeve, and to prevent said transfer ball from completely exiting said mounting hole;

(e) a plurality of deformable membranes each adapted to cover said transfer ball;

(f) an inner sleeve having a crenated axial profile, having radial bands each comprising at a down-hole portion a trough corresponding to the size of said transfer balls and at an up-hole portion a ramped gradual increase in circumference up to a maximum circumference allowing sliding within said outer sleeve, having on an up-hole portion a stepped reduction in circumference forming an outer shoulder, and having a mounting point on an up-hole end for attachment to up-hole components of the drill string; and (g) a guide-retainer ring having an outer surface adapted to mount upon said outer sleeve, having an inner surface adapted to allow sliding movement of said inner sleeve, and having a down-hole surface adapted to serve as an inner shoulder upon said outer sleeve;

(ii) using said storm plug packer in an un-set state where, when the drill string places an upward force on said inner sleeve, said inner sleeve slides upward within said outer sleeve to the limit of contact between the outer shoulder of said inner sleeve and the inner shoulder of said guide-retainer ring and said outer sleeve, where said transfer balls are accommodated within the troughs of said inner sleeve, and where said transfer balls do not extend beyond the normal circumference of said outer sleeve;

(iii) using said storm plug packer in a set state where, when the drill string does not place an upward force on said inner sleeve, said inner sleeve slides downward within said outer sleeve, placing the gradual increased circumference portions of said inner sleeve in contact with said transfer balls, forcing said transfer balls radially outward, to the limit of said ball-retainer rings, against said deformable membranes, and past the normal circumference of said outer sleeve into frictional contact with the casing, thereby setting said storm plug packer and attached down-hole components in fixed positions within the casing; and (iv) returning said storm plug packer to an un-set state where, upon re-application of an upward force to said inner sleeve, said inner sleeve slides back into the position allowing said transfer balls to retract into the troughs of said inner sleeve, thereby unsetting said storm plug packer, allowing movement of the drill string.

12. The storm plug packer method of claim 11, where said deformable membranes are made of rubber.

13. The storm plug packer method of claim 11, where said deformable membranes are made of silicone material.

14. The storm plug packer method of claim 11, where said transfer balls are made of steel.

15. The storm plug packer method of claim 11, where said transfer balls are made of a non-sparking material.

16. The storm plug packer method of claim 11, where said transfer balls are made of brass.

17. The storm plug packer method of claim 11, where said guide-retainer ring is made of a non-sparking material.

18. The storm plug packer method of claim 11, where said storm plug packer apparatus further comprises manufacture of said transfer balls from non-sparking materials.

19. The storm plug packer method of claim 11, where said storm plug packer apparatus further comprises fifty of said transfer balls.

20. The storm plug packer method of claim 11, where each said radial band further comprises ten said mounting holes radially arrayed.

* * * * *